US006678387B2

(12) United States Patent
Kemmerer

(10) Patent No.: US 6,678,387 B2
(45) Date of Patent: Jan. 13, 2004

(54) LOUDSPEAKER HAVING COOLING SYSTEM

(75) Inventor: Jason Kemmerer, Thousand Oaks, CA (US)

(73) Assignee: Alpine Electronics, Inc., Tokyo (JP)

( * ) Notice: Subject to any disclaimer, the term of this patent is extended or adjusted under 35 U.S.C. 154(b) by 132 days.

(21) Appl. No.: 10/020,597

(22) Filed: Oct. 30, 2001

(65) Prior Publication Data

US 2003/0081808 A1 May 1, 2003

(51) Int. Cl.[7] ..... A04R 25/00

(52) U.S. Cl. ..... 381/397; 381/404; 381/412; 381/420; 381/419; 181/148; 181/156; 181/199

(58) Field of Search ..... 381/397, 404, 381/412, 420, 411, 419, FOR 152, FOR 159, 405, 421, 422; 181/148, 156, 199, 154, 161, 171

(56) References Cited

U.S. PATENT DOCUMENTS 4,590,332 A * 5/1986 Delbuck
5,357,586 A 10/1994 Nordschow et al.
5,909,015 A 6/1999 Yamamoto et al.
6,229,902 B1 5/2001 Proni
6,243,479 B1 6/2001 Proni
6,430,300 B1 * 8/2002 Cox

* cited by examiner

*Primary Examiner*—Curtis Kuntz
*Assistant Examiner*—Dionne Harvey
(74) *Attorney, Agent, or Firm*—Muramatsu & Associates

(57) ABSTRACT

A loudspeaker having an improved air cooling system. The loudspeaker includes a speaker frame, a diaphragm connected to the speaker frame, a voice coil which is formed on a voice coil bobbin and is connected to the diaphragm for vibrating the diaphragm, a permanent magnet having a central opening, a pole piece disposed coaxially within the central opening of the permanent magnet to form an air gap into which the voice coil is disposed, and a heat transfer plate disposed over the permanent magnet. The heat transfer plate has a plurality of cooling fins which are radially outwardly extending toward an outer rim thereof and inner and outer air openings on the outer rim. The outer rim has a step like shape in cross section and has a flat upper surface which is higher than top ends of the cooling fins. The vibration of the diaphragm produces air flows through air passages on the heat transfer plate between the inside and outside of the loudspeaker.

13 Claims, 5 Drawing Sheets

LOUDSPEAKER HAVING COOLING SYSTEM

FIELD OF THE INVENTION

This invention relates to a loudspeaker for audio and video applications, and more particularly, to a loudspeaker having an improved air cooling system.

BACKGROUND OF THE INVENTION

Loudspeakers, or speakers, are well known in the art and are commonly used in a variety of applications, such as in home theater stereo systems, car audio systems, indoor and outdoor concert halls, and the like. A loudspeaker typically includes an acoustic transducer comprised of an electromechanical device which converts an electrical signal into acoustical energy in the form of sound waves and an enclosure for directing the sound waves produced upon application of the electrical signal.

A loudspeaker comprises a coil of wire, typically referred to as a voice coil, which is suspended between a pole piece and a permanent magnet. In operation, an alternating current from an amplifier flows through the voice coil which produces a changing magnetic field around the voice coil. The changing magnetic field around the voice coil interacts with the magnetic field produced by the permanent magnet to produce reciprocal forces on the voice coil representing the current in the voice coil.

The voice coil is disposed within the loudspeaker so that it can oscillate in accordance with the reciprocal forces along the pole piece. The voice coil is attached to a cone shaped diaphragm which vibrates in response to the oscillation (reciprocal movement) of the voice coil. The vibration of the diaphragm produces acoustic energy in the air, i.e., a sound wave.

The voice coil is constructed of a conductive material having electrical resistance. As a consequence, when an electrical signal is supplied to the voice coil, the electric current flowing through the coil generates heat because of the interaction with the resistance. Therefore, the temperature within the loudspeaker and its enclosure will increase. This resistance in the voice coil to the current flow represents a significant part of the loudspeaker's impedance, and a substantial portion of the electrical input power is converted into heat rather than into acoustic energy.

Such temperature rise in the voice coil creates various disadvantages. As an example of disadvantage, it has been found that significant temperature rise increases the resistance of the voice coil. This, in turn, results in a substantial portion of the input power of the loudspeaker to be converted to the heat, thereby lowering the efficiency and performance of the loudspeaker. In particular, it has been found that increased resistance of the voice coil in the loudspeaker can lead to non-linear loudness compression effects at high sound levels.

When additional power is supplied to compensate for the increased resistance, additional heat is produced, again causes an increase in the resistance of the voice coil. At some point, any additional power input will be converted mostly into heat rather than acoustic output. Further, significant temperature rise can melt bonding materials in the voice coil or burn out the voice coil, resulting in permanent structural damage to the loudspeaker.

Various methods have been applied to both loudspeakers and speaker systems to improve heat dissipation, including improved conduction and convection techniques, venting, and the use of forced air cooling with fan-type devices. However, no adequate, practical and affordable solution has been found to maintain desirable operating temperatures under high power conditions.

For example, in U.S. Pat. No. 5,357,586, there is disclosed a flow-through air-cooled loudspeaker system. The loudspeaker and the enclosure are provided with air passages which are aerodynamically-shaped. The air passages provide low-pressure regions for inducing flows of air into and about the driver motor of the loudspeaker in response to the vibratory movement of the speaker diaphragm. Further, an aerodynamically-shaped body is disposed within the pole piece to define a ventilation passage for exchange of air between an interior chamber defined by a coil former and the back of the speaker.

Aerodynamically-shaped openings are provided through the pole piece for inducing flow of air about the voice coil in the voice coil gap between the pole piece and permanent magnet. The speaker frame support is provided with aerodynamically-shaped openings to induce air flow into the interior chamber. In this manner, low-pressure regions established by the aerodynamic shapes induce flow of cooling air about the voice coil and pole piece in response to vibratory movement of the cone. Aerodynamic shapes are disposed in the intake and exhaust vents of the speaker enclosure to exchange air between the enclosure and atmosphere in response to vibratory movement of the speaker diaphragm.

The loudspeaker system in U.S. Pat. No. 5,357,586 has drawbacks. For example, to establish the air passages, the voice coil former has a plurality of apertures or openings circumferentially spaced thereabout. Such apertures play a role of additional resistance against reciprocal movement of the voice coil former or the vibration of the diaphragm. Thus, such a structure having apertures on the voice coil former degrades the sound quality of the loudspeaker and may also weaken the voice coil structure.

Other methods such as cooling fans and pressurized air have been used in both loudspeakers and speaker systems, but are cumbersome, unreliable and expensive. The methods that employ electrical motors which draw from the electrical audio signal cause an unacceptable decrease in system efficiency.

SUMMARY OF THE INVENTION

It is, therefore, an object of the present invention to provide a loudspeaker having an improved cooling system which is free from the problems associated with the conventional loudspeaker cooling system.

It is another object of the present invention to provide a loudspeaker having an improved cooling system which utilizes air flow to prevent significant temperature rise in the voice coil.

It is a further object of the present invention to provide a loudspeaker having an improved cooling system which produces air flows to prevent significant temperature rise in the voice coil through the vibration of the speaker diaphragm during normal operation.

It is a further object of the present invention to provide a loudspeaker having an improved cooling system in which a heat transfer plate is separately formed from the speaker frame, thereby simplifying the design and decreasing the overall cost of the loudspeaker.

It is a further object of the present invention to provide a loudspeaker having an improved cooling system in which a heat transfer plate is structured to prevent unwanted particles from coming in the loudspeaker when ventilating the air.

Accordingly, a loudspeaker of the present invention is comprised of a speaker frame, a diaphragm connected to the speaker frame in a manner capable of vibration, a voice coil which is formed on a voice coil bobbin and is connected to the diaphragm for vibrating the diaphragm, a permanent magnet having a central opening, a pole piece disposed coaxially within the central opening of the permanent magnet to form an air gap between the pole piece and the permanent magnet into which the voice coil is disposed, and a heat transfer plate made of non-magnetic and thermal conductive material and disposed over the permanent magnet.

The heat transfer plate has a plurality of cooling fins which are radially outwardly extending toward an outer rim thereof and inner and outer air openings on the outer rim. The heat transfer plate forms air passages each having an air path formed between two adjacent cooling fins and said inner and outer air openings. The vibration of the diaphragm produces air flows through the air passages to intake cool air and exhaust heated air between the inside and outside of the loudspeaker.

The cooling fin is inclined in a manner to increase its height toward the outer rim, and the outer rim has a step like shape in cross section and has a flat upper surface which is higher than top ends of the cooling fins. The heat transfer plate has a floor which is inclined toward the outer rim in a degree smaller than that of the cooling fins, the air path which is a channel defined by two adjacent cooling fins is continuous to said inner air openings provided at an inside wall of the outer rim while the outer air openings are provided at an outside wall of the outer rim.

The inner air opening and said outer air opening formed at the outer rim have different positions relative to an axial direction of the loudspeaker from one another. The inner air opening has a wall and the outer air opening has a projection to bend the air passage between the inner air opening and the outer air opening, thereby preventing unwanted particles from coming inside of said loudspeaker.

The pole piece has an axial opening to establish an axial air passage between the inner area of the voice coil bobbin and the outside of the loudspeaker. The vibration of the diaphragm produces air flows through the axial air passages to intake cool air and exhaust heated air between the inside and outside of the loudspeaker.

According to the present invention, the loudspeaker has an improved air cooling system which utilizes air flow to prevent significant temperature rise in the voice coil. The air cooling system produces air flows to prevent significant temperature rise in the voice coil through the vibration of the speaker diaphragm during the normal operation.

In the loudspeaker of the present invention, the heat transfer plate is separately formed from the speaker frame, thereby simplifying the design and decreasing the overall cost of the loudspeaker. Further, the heat transfer plate is structured to prevent unwanted particles from coming in the loudspeaker when ventilating the air, which maintains the performance level of the loudspeaker.

DETAILED DESCRIPTION OF THE INVENTION

Figure 1:
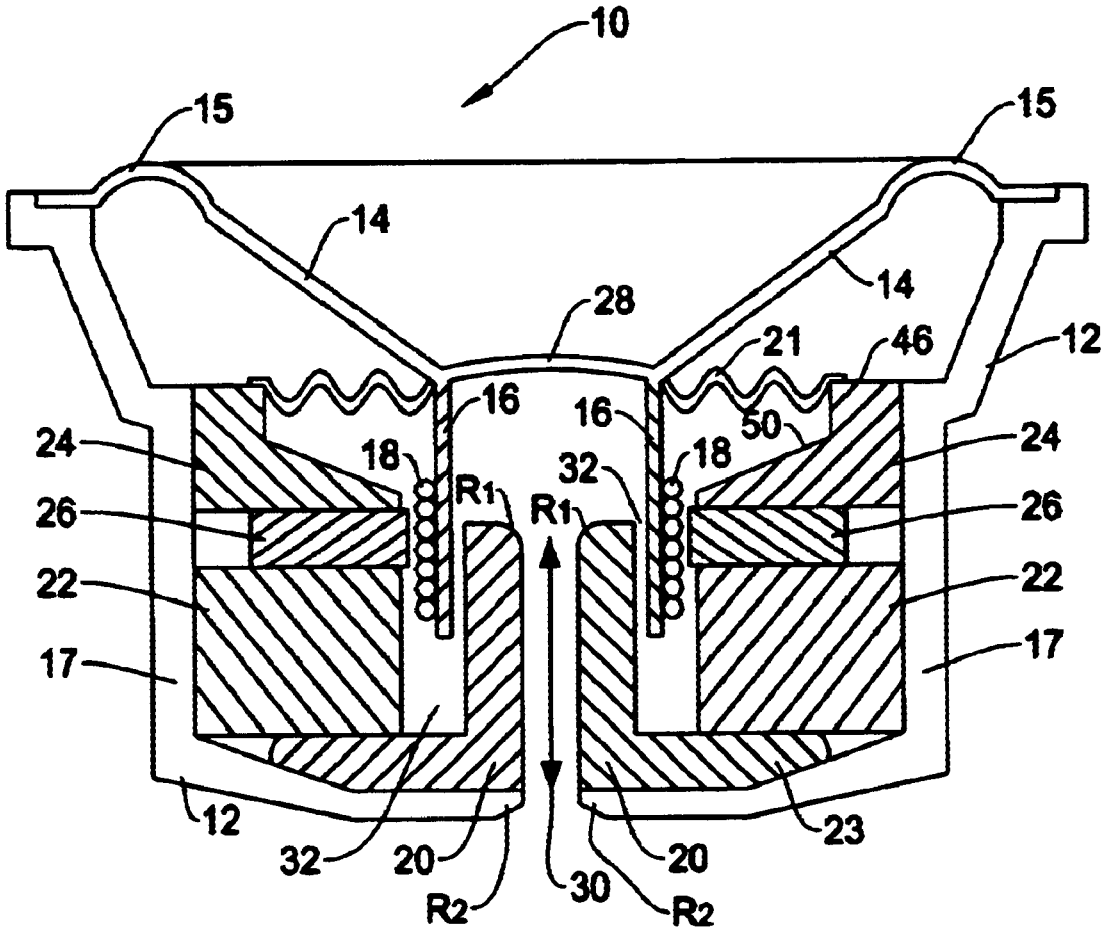
FIG. 1 is a cross sectional view on line I—I in FIG. 4 showing an example of structure in the loudspeaker constructed in accordance with the present invention.

Referring now to the drawings, there is illustrated a loudspeaker, constructed in accordance with the present invention and generally designated by a reference number 10 which may be disposed in a speaker cabinet or on an automobile inner wall. Although not shown, electrical terminals are provided to the loudspeaker to supply an electrical input signal to a voice coil of the loudspeaker whereby the electrical energy is converted into acoustical energy in the form of sound waves.

Figure 4:
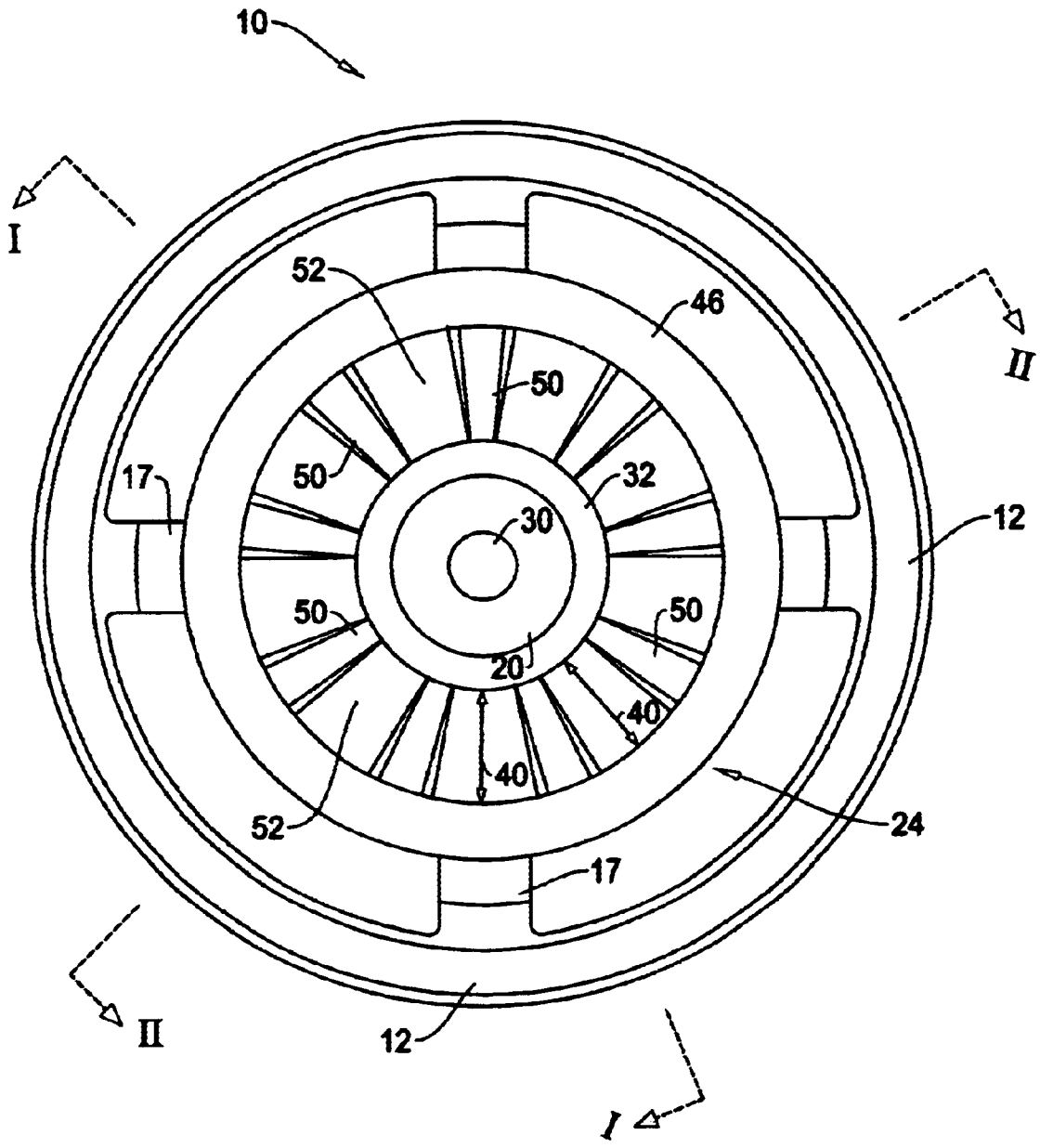
FIG. 4 is a plan view of the loudspeaker of the present invention without the diaphragm 14, coil bobbin 16 and spider 21 in FIGS. 1 and 2.

With reference to FIG. 1, which is a cross sectional view taken along a I—I line in FIG. 4, the loudspeaker 10 includes a speaker cone or a diaphragm 14, a coil bobbin 16, and a dust cap 28. The diaphragm 14, the dust cap 28 and the coil bobbin 16 are attached to one another by, for example, an adhesive. Typically, the coil bobbin 16 is made of a high temperature resistant material such as glass fiber or aluminum around which an electrical winding or a voice coil 18 is attached such as by an adhesive. The voice coil 18 is connected to suitable leads (not shown) to receive an electrical input signal through the electrical terminals (not shown) noted above.

The diaphragm 14 is provided with an upper half roll 15 at its peripheral made of flexible material such as an urethane foam, butyl rubber and the like. The diaphragm 14 is connected to the speaker frame 12 at the upper half roll 15 by means of, for example, an adhesive. The speaker frame 12 has a plurality of radially and downwardly extending frame members 17 and is integrally constructed of a stiff antivibrational material, such as aluminum.

At about the middle of the speaker frame 12, the intersection of the diaphragm 14 and the coil bobbin 16 is connected to the speaker frame 12 through an inner end of a spider (inner suspension) 21 made of a flexible material such as cotton with phenolic resin and the like. The upper half roll 15 and the spider 21 allow the flexible vertical movements of the diaphragm 14 as well as limit or damp the amplitudes (movable distance in an axial direction) of the diaphragm 14 when it is vibrated in response to the electrical input signal.

The loudspeaker 10 also comprises a magnetic assembly (circuit) formed of an air gap 32 and annular members including a pole piece 20, a permanent magnet 22, and an upper plate 26. The pole piece 20 has a back plate 23 at the inner bottom of the speaker frame 12. The pole piece 20, the permanent magnet 22 and the upper plate 26 are positioned axially inward from the speaker frame 12. The pole piece 20 has a central opening (air passage) 30 in the axial direction.

The permanent magnet 22 is disposed between the upper plate 26 and the back plate 23. The upper plate 26 and the back plate 23 are constructed from a material capable of carrying magnetic flux, such as steel. Therefore, a magnetic path is created through the pole piece 20, the upper plate 26, the permanent magnet 22 and the back plate 23 through which the magnetic flux is running.

An air gap 32 is created between the pole piece 20 and the upper plate 26 in which the voice coil 18 and the coil bobbin 16 are inserted in the manner shown in FIG. 1. Thus, when the electrical input signal is applied to the voice coil 18, the current flowing in the voice coil 18 and the magnetic flux (flux density) interact with one another. This interaction produces a force on the voice coil 18 which is proportional to the product of the current and the flux density. This force activates the reciprocal movement of the voice coil 18 on the coil bobbin 16, which vibrates the diaphragm 14, thereby producing the sound waves.

In accordance with the present invention, there is disposed on the upper plate 26 a heat transfer plate 24 having cooling fins, air openings and air paths to establish air passages. The heat transfer plate 24 is made of high thermal conductive non-magnetic material such as aluminum. In this example, an outer peripheral of the spider 21 is attached to the outer rim of the heat transfer plate 24. The heat transfer plate 24 has a vertical cross section in close proximity to the voice coil 18 and thus, efficiently transfers the heat produced by the voice coil 18 toward the outside of the loudspeaker. The details of the heat transfer plate 24 will be described with reference to FIGS. 2–6.

Figure 2:
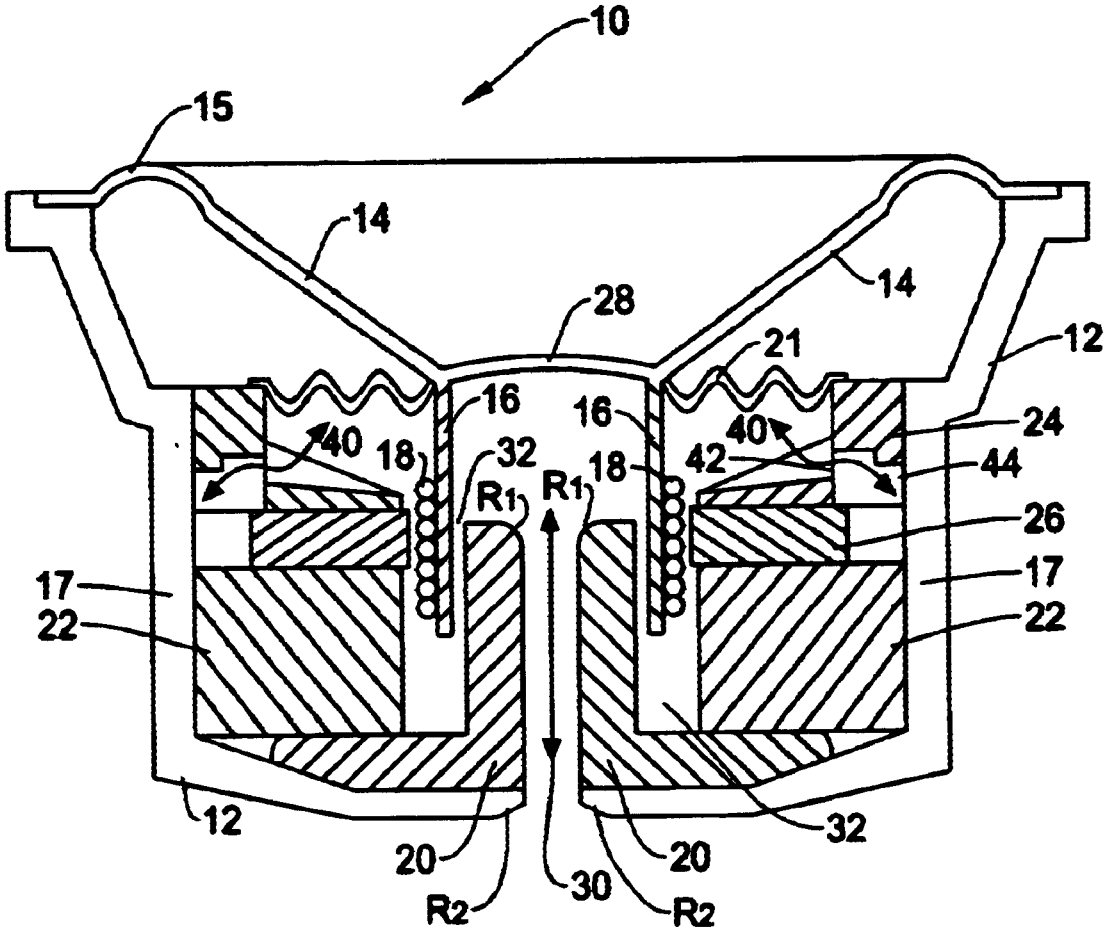
FIG. 2 is a cross sectional view on line II—II in FIG. 4 showing the structure in the loudspeaker constructed in accordance with the present invention.

In the cross sectional view of FIG. 1, the heat transfer plate 24 is illustrated only by the cooling fins 50 and the outer rim 46. FIG. 2 is a cross section view of the loudspeaker of the present invention taken along a II—II line of FIG. 4. FIG. 2 shows the heat transfer plate 24 which creates air passages each having an air path between the two adjacent cooling fins 50 and air openings 42 and 44 running through the outer rim 46.

The heat generated by the voice coil 18 is exhausted through the air passages in the heat transfer plate 24 and an outside cool air is introduced through the air passages toward the voice coil 18, thereby decreasing the inner temperature. The heat generated by the voice coil 18 is also cooled by the fins 50 of the heat transfer plate 24. In other words, the heat transfer plate 24 mainly functions to cool the outer area of the coil bobbin 16.

The pole piece 20 has an air passage (opening) 30 in the axial direction which exhausts the heated air toward the outside and intakes the cool air from outside. Thus, the air passage 30 mainly functions to cool the inner area of the coil bobbin 16. Preferably, to promote smooth air flows, surfaces $R_1$ and $R_2$ the top and bottom ends of the air passage 30 are rounded as shown in FIGS. 1 and 2.

Figure 3:
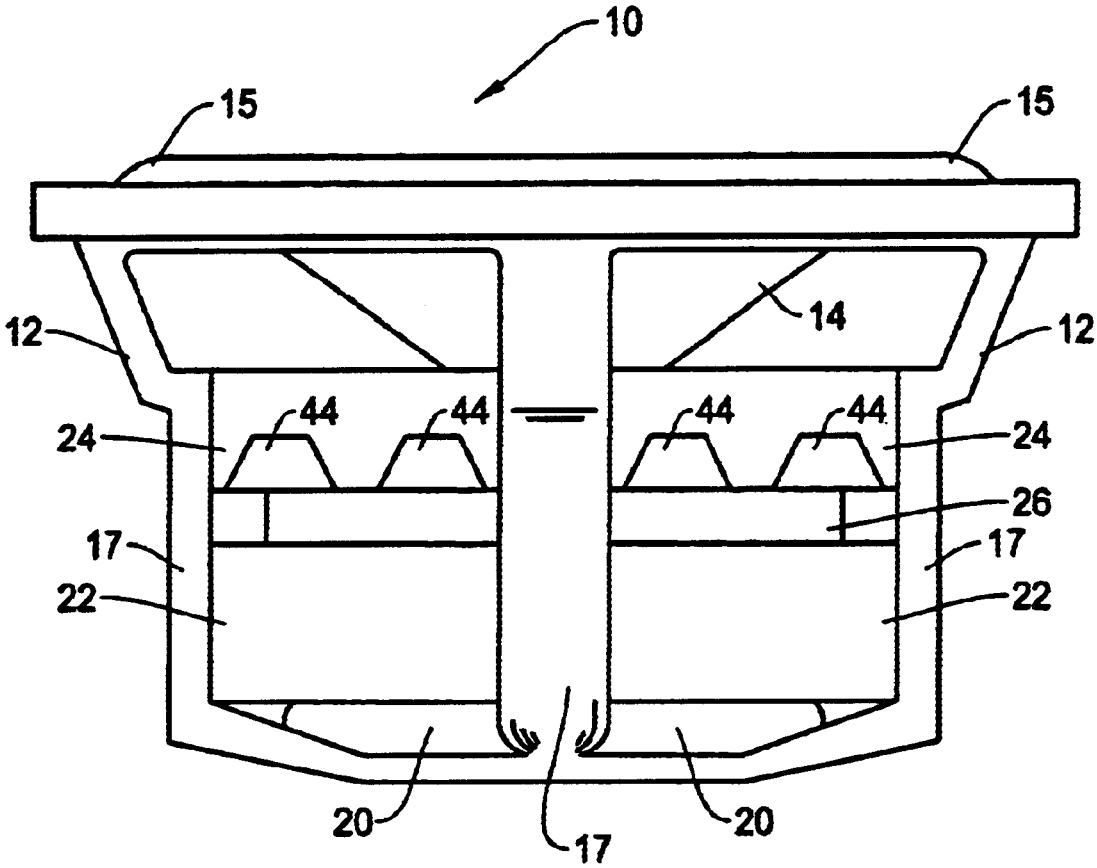
FIG. 3 is a front view of the loudspeaker of the present invention.

FIG. 3 is a front view of the loudspeaker 10 of the present invention. In this example, the speaker frame 12 has four frame members 17 in a symmetrical fashion which are integrally formed to establish an inner space. The pole piece 20, the permanent magnet 22, the upper plate 26, the heat transfer plate 24, and the set of voice coil and diaphragm 14 are assembled in this inner space. A relatively large space is created between the two adjacent frame members 17. Thus, the air openings 44 at the outside of the heat transfer plate 25 are exposed to the outer atmosphere to exhaust and intake the air between the inside of the loudspeaker 10 and the outer atmosphere.

FIG. 4 is a plan view of the loudspeaker 10 of the present invention without the diaphragm 14, the coil bobbin 16 and the spider 21 of FIGS. 1 and 2. Between the speaker frame 12 and the pole piece 20, there is disposed the heat transfer plate 24. The air gap 32 is created between the pole piece 20 and the heat transfer plate 24 (upper plate 26 and the permanent magnet 22) for inserting the coil bobbin 16 and the voice coil 18 therein.

The heat transfer plate 24 has a plurality of cooling fins 50 radially outwardly extending toward the outer rim 46. The height and thickness of each cooling fin 50 increase toward the outer rim 46 which is designed to have a surface area as large as possible so long as the cooling fins 50 do not interfere the vibration of the diaphragm 14. The cooling fins 50 cool the loudspeaker 10 through thermal radiation. The heat transfer plate 24 contacts the speaker frame 12 at the outer rim 46 to transfer the heat to the frame 12 and an enclosure (not shown) through thermal conduction.

Figure 5:
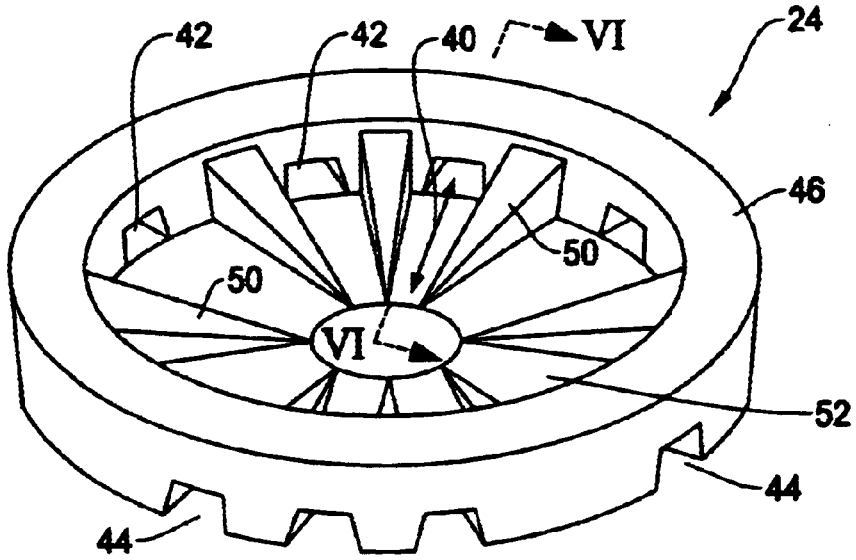
FIG. 5 is a perspective view of the heat transfer plate 24 incorporated in the loudspeaker of the present invention.
Figure 6:
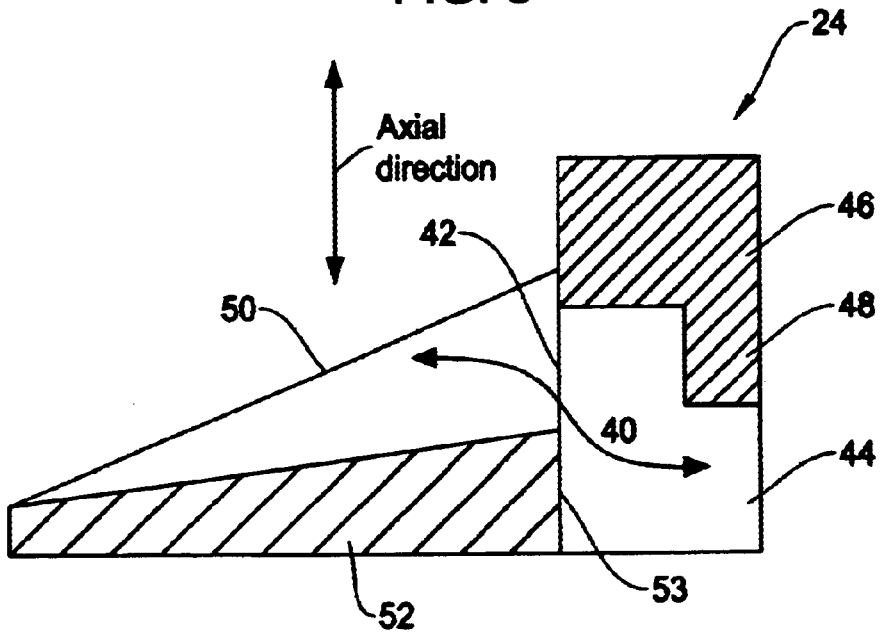
FIG. 6 is an enlarged cross sectional view on VI—VI line of FIG. 5 showing a part of the heat transfer plate 24 for use in the loudspeaker of the present invention.

Between the two adjacent fins 50, an air path is created to introduce the air between the inside and outside of the loudspeaker 10 through the air passages 40 created in combination with the air openings 42 and 44 (see also FIGS. 5 and 6). The pole piece 20 has the air passage 30 in the axial direction (FIGS. 2 and 3) for cooling the inner area of the coil bobbin 16. Thus, the air passage 30 in the pole piece 20 and the air passages 40 in the heat transfer plate 24 cool the loudspeaker 10 through thermal convection.

FIG. 5 is a perspective view of the heat transfer plate 24 incorporated in the loudspeaker of the present invention. The heat transfer plate 24 has a center bore from which a plurality of cooling fins 50 are radially outwardly extended. A trench like air path is created between the two adjacent fins 50 to exhaust the heated air to the outside and to introduce the cool air to the inside through the air openings 42 and 44.

The height of the cooling fins 50 is minimum at the center bore and increases toward the outer rim 46. In other words, the upper surfaces of the cooling fins 50 are upwardly inclined toward the outer rim 46. Further, the outer rim 46 is shaped like a step in cross section which is higher than the fins 50. The upper surface of the outer rim 46 is flat on which the outer periphery of the spider 21 is attached by, for example, an adhesive as shown in FIGS. 1 and 2.

The shape of the cooling fins 50 and the outer rim 46 is designed to have a high heat exchange efficiency, i.e., to have a large overall surface area. Also, the shape of the cooling fins 50 and the outer rim 46 maintains a sufficient space between the spider 21 and the heat transfer plate 24 during the vibration, thereby avoiding adverse effects on the sound quality.

FIG. 6 is an enlarged cross sectional view on VI—VI line of FIG. 5 showing a part of the heat transfer plate 24 The heat transfer plate 24 has a floor 52 which is slightly inclined toward the outer rim 46, thereby creating a wall 53 in the air passage 40. The floor 52 also makes the inner air openings 42 positioned higher than the outer air openings 44 in the axial direction of the loudspeaker. A projection 48 is provided downwardly at the outer periphery of the heat transfer plate 24.

As noted above, the air openings 42 and 44 are positioned on the different vertical levels in the axial direction, and the walls 53 and the projections 48 are provided in the air passage 40 in the manner shown in FIG. 6. In other words, the air passage 40 is not straightly formed but is rather bend or curved. This structure is effective in preventing stray particles, such as dust or waterdrops from coming inside of the loudspeaker 10. Other unwanted particles, such as magnetized particles or metallic dust are attracted by the magnetic force produced by the permanent magnet 26 at the outside of the loudspeaker 10, thereby unable to come inside of the loudspeaker 10.

Further, since the heat transfer plate 24 is separately formed from the speaker frame, for applying this invention to a loudspeaker of different size and shape, only the heat transfer plate 24 has to be newly designed for such a loudspeaker. Therefore, the cooling system in the present invention can reduce an overall turn around time for designing the loudspeakers and also decrease an overall cost of the loudspeakers.

In operation, when the electrical input signal is applied to the voice coil 18, the diaphragm 14 vibrates in the up-down direction of FIGS. 1 and 2 in response to the electrical input signal. The voice coil 18 generates heat as a function of the resistance thereof and the current flowing therethrough, which increases the temperature inside the loudspeaker 10.

In the loudspeaker of the present invention, when the diaphragm 14 moves upward, cool air is inhaled through the air passage 30 in the pole piece 20 and the air passages 40 in the heat transfer plate 24. Conversely, when the diaphragm 14 moves downward, warm air is exhausted through the air passages 30 and 40.

As described in the foregoing, according to the present invention, the loudspeaker has an improved air cooling system which utilizes air flow to prevent significant temperature rise in the voice coil. The air cooling system produces air flows to prevent significant temperature rise in the voice coil through the vibration of the speaker diaphragm during the normal operation.

In the loudspeaker of the present invention, the heat transfer plate is separately formed from the speaker frame, thereby simplifying the design and decreasing the overall cost of the loudspeaker. Further, the heat transfer plate is structured to prevent unwanted particles from coming in the loudspeaker when ventilating the air, which maintains the performance level of the loudspeaker.

Although only a preferred embodiment is specifically illustrated and described herein, it will be appreciated that many modifications and variations of the present invention are possible in light of the above teachings and within the purview of the appended claims without departing the spirit and intended scope of the invention.

What is claimed is:

1. A loudspeaker comprising:

a speaker frame;

a diaphragm connected to said speaker frame in a manner capable of vibration;

a voice coil which is formed on a voice coil bobbin and is connected to said diaphragm for vibrating the diaphragm;

a permanent magnet having a central opening;

a pole piece disposed coaxially within the central opening of said permanent magnet to form an air gap between said pole piece and said permanent magnet into which said voice coil is disposed; and a heat transfer plate made of non-magnetic and thermal conductive material and disposed over said permanent magnet, said heat transfer plate having a plurality of cooling fins which are radially outwardly extending toward an outer rim thereof and inner and outer air openings on the outer rim, thereby forming air passages each having an air path formed between two adjacent cooling fins and said inner and outer air openings;

where each of said cooling fin is inclined in a manner to increase its height toward the outer rim, and the outer rim has a step like shape in cross section and has a flat upper surface which is higher than top ends of said cooling fins; and wherein the vibration of said diaphragm produces air flows through said air passages to intake cool air and exhaust heated air between the inside and outside of the loudspeaker.

2. A loudspeaker as defined in claim 1, wherein said heat transfer plate has a floor which is inclined toward the outer rim in a degree smaller than that of said cooling fins, the air path which is a channel defined by two adjacent cooling fins is continuous to said inner air openings provided at an inside wall of the outer rim while the outer air openings are provided at an outside wall of the outer rim.

3. A loudspeaker as defined in claim 1, wherein said inner air opening formed at the inner rim and said outer air opening formed at the outer rim have different positions from one another in an axial direction of said loudspeaker, and said inner air opening has a wall and said outer air opening has a projection to bend or curve the air passage between said inner air opening and said outer air opening, thereby preventing unwanted particles from coming inside of said loudspeaker.

4. A loudspeaker as defined in claim 1, wherein said heat transfer plate has a floor which is slightly inclined toward the outer rim and is continuous to said inner air openings provided at an inside wall of the outer rim while the outer air openings are provided at an outside wall of the outer rim.

5. A loudspeaker as defined in claim 1, wherein said heat transfer plate has a central bore which substantially matches with the central opening of said permanent magnet thereby allowing the voice coil be disposed in said air gap between said pole piece and said permanent magnet.

6. A loudspeaker as defined in claim 1, further comprising an upper plate and a back plate in a manner to sandwich said permanent magnet therebetween, said top plate and said back plate are made of magnetic material thereby forming a magnetic path in combination with said pole piece and said permanent magnet.

7. A loudspeaker as defined in claim 1, said pole piece has an axial opening to establish an axial air passage between the inner area of said voice coil bobbin and the outside of said loudspeaker wherein the vibration of said diaphragm produces air flows through said axial air passages to intake cool air from the outside of the loudspeaker and exhaust heated air from the inside of the loudspeaker.

8. A loudspeaker as defined in claim 7, wherein surfaces of an upper end and a lower end of said axial air passage are rounded to promote smooth air flows between the inner area of said voice coil bobbin and the outside of said loudspeaker.

9. A loudspeaker comprising:

a speaker frame;

a diaphragm connected to said speaker frame in a manner capable of vibration;

a voice coil which is formed on a voice coil bobbin and is connected to said diaphragm for vibrating the diaphragm;

a magnetic circuit having an air gap into which said voice coil is disposed;

a heat transfer plate made of non-magnetic and thermal conductive material and disposed over said magnetic circuit, said heat transfer plate having a plurality of cooling fins which are radially outwardly extending toward an outer rim thereof and inner and outer air openings on the outer rim, thereby forming air passages each having an air path formed between two adjacent cooling fins and said inner and outer air openings; and a spider made of a flexible material, an inner end of said spider being connected to said diaphragm and said voice coil, and an outer peripheral of said spider being connected to an upper surface of the outer rim of said heat transfer plate;

wherein the vibration of said diaphragm produces air flows through said air passages to intake cool air and exhaust heated air between the inside and outside of the loudspeaker.

10. A loudspeaker as defined in claim 9, wherein each of said cooling fin is inclined in a manner to increase its height toward the outer rim, and the outer rim has a step like shape in cross section and has a flat upper surface which is higher than top ends of said cooling fins.

11. A loudspeaker as defined in claim 9, wherein each of said cooling fin is inclined in a manner to increase its height toward the outer rim, said heat transfer plate has a floor which is inclined toward the outer rim in a degree smaller than that of said cooling fins, the air path which is a channel defined by two adjacent cooling fins is continuous to said inner air openings provided at an inside wall of the outer rim while the outer air openings are provided at an outside wall of the outer rim.

12. A loudspeaker as defined in claim 9, wherein said inner air opening formed at the inner rim and said outer air opening formed at the outer rim have different positions from one another in an axial direction of said loudspeaker, and said inner air opening has a wall and said outer air opening has a projection to bend or curve the air passage between said inner air opening and said outer air opening, thereby preventing unwanted particles from coming inside of said loudspeaker.

13. A loudspeaker as defined in claim 9, wherein said heat transfer plate has a floor which is slightly inclined toward the outer rim and is continuous to said inner air openings provided at an inside wall of the outer rim while the outer air openings are provided at an outside wall of the outer rim.

* * * * *